United States Patent [19]

Lockard

[11] 4,280,311

[45] Jul. 28, 1981

[54] METHOD AND APPARATUS FOR FASTENING A SHEET OF MATERIAL TO A SUPPORT

[75] Inventor: Donald F. Lockard, Littleton, Colo.

[73] Assignee: Johns-Manville Corporation, Denver, Colo.

[21] Appl. No.: 958,772

[22] Filed: Nov. 8, 1978

[51] Int. Cl.[3] ..... E04D 1/00; E04D 3/36

[52] U.S. Cl. ..... 52/748; 52/546; 52/548

[58] Field of Search ..... 52/748, 747, 548, 546, 52/543, 544, 545; 29/432; 85/49, 29, 23

[56] References Cited

U.S. PATENT DOCUMENTS

| | | | |
|---|---|---|---|
| 2,057,003 | 10/1936 | Bugher | 52/548 |
| 2,424,410 | 7/1947 | Miles | 52/748 |
| 3,824,756 | 7/1974 | Kessler | 52/546 |
| 4,102,106 | 7/1978 | Golder | 52/546 |

*Primary Examiner*—John E. Murtagh

*Attorney, Agent, or Firm*—Robert M. Krone; Joseph J. Kelly; Gregory W. O'Connor

[57] ABSTRACT

A method of fastening a sheet of material to a support by first positioning the sheet material adjacent the support, cutting an elongated slot in the sheet material while embedding a portion of the sheet material in the support, securing a fastener to the support by moving a first fastener portion into frictional engagement with the support, positioning a second portion of the fastener to extend through the slot and providing a fastening portion to the fastener is disclosed. The slot is larger than the portion of the fastening means positioned therein so as to permit relative movement between the sheet material and the fastening means. This capability for relative movement between the sheet material and the support accommodates for thermal expansion and contraction of the sheet material thereby preventing binding and buckling of sheet material while retaining its alignment on the support.

4 Claims, 13 Drawing Figures

METHOD AND APPARATUS FOR FASTENING A SHEET OF MATERIAL TO A SUPPORT

BACKGROUND OF THE INVENTION

The present invention relates in general to a method and apparatus for fastening a sheet of material to a support. More particularly, the present invention relates to fastening a vinyl siding sheet material to a wall stud in such a manner as to provide relative movement between the vinyl siding and the support stud. The present invention also relates to a suitable fastener for use with the method and apparatus according to the present invention. The invention is especially suitable for the installation of vinyl siding in the modular or mobile home industry.

Vinyl siding sheet material is generally provided in elongated sections, a typical section dimension being 12'6"×9½". When such sections are rigidly affixed to a supporting structure, longitudinal expansion and contraction of the material in response to temperature variations results in the sections buckling or binding. Heretofore, for preventing binding or buckling of vinyl siding it was necessary to provide longitudinally extending slots in the siding and to attach the siding to the supporting structure by fastening means which did not rigidly hold the siding onto the supporting structure and which loosely fit through the slot, the longitudinal extent of that portion of the fastening means being appreciably less than the length of the slot so as to provide for relative movement of siding and support structure. Thus, the vinyl siding industry has provided sections of vinyl siding with factory formed slots along a nailing strip at an upper edge portion of the vinyl siding sections. With this arrangement, fastening means, such as nails or staples can be driven through the hole or slot and into the supporting structure.

In the mobile or modular home industry where assembly line production methods require quick and easy installation of siding, the problem often arises wherein support or wall stud spacing, placement or dimensions do not correspond conveniently with the spacing of the pre-cut siding slots. Thus, with the prior art, particularly as applied to the mobil home industry, quick, yet proper installation of siding to support structure has not been facilitated.

It is an object of the present invention to overcome the disadvantages of preformed, slotted siding material by providing a method and apparatus for forming a suitable slot in the sheet material during installation of the siding material.

It is also an object of the invention to provide a method and apparatus for providing suitable fastening means for holding the siding material in place.

BRIEF SUMMARY OF THE INVENTION

Accordingly, the present invention provides a method and apparatus for installing a sheet material such as vinyl siding to a support, such as a wall stud, comprising positioning the sheet material adjacent the support; moving a first portion of a fastener means through the sheet material and into the support at a location adjacent an edge of the sheeting so as to at least partially cut an elongated slot therein; positioning a second portion of the fastener so that it extends through the slot; and controlling the dimensions of the slot so that it is larger than that portion of the fastener means located within the slot thereby permitting relative movement between sheeting and fastening means. The invention also includes providing a fastening portion on the fastener which preferably includes forming an initially straight third portion of the fastener into a loop that extends over an adjacent edge of the sheeting and into contact with the support structure so as to limit movement of the sheet material away from the support.

The present invention also provides a staple-like, integral fastener for attaching a sheet of material to a substrate support structure, which fastener has first, second and third portions, and an end view configuration resembling three sides of a rectangle. The first portion comprises a U-shaped structure, and the second portion comprises a shank extending from the connecting portion of the U and the third portion comprises an extension of the shank.

DETAILED DESCRIPTION OF THE DRAWINGS

Figure 1:
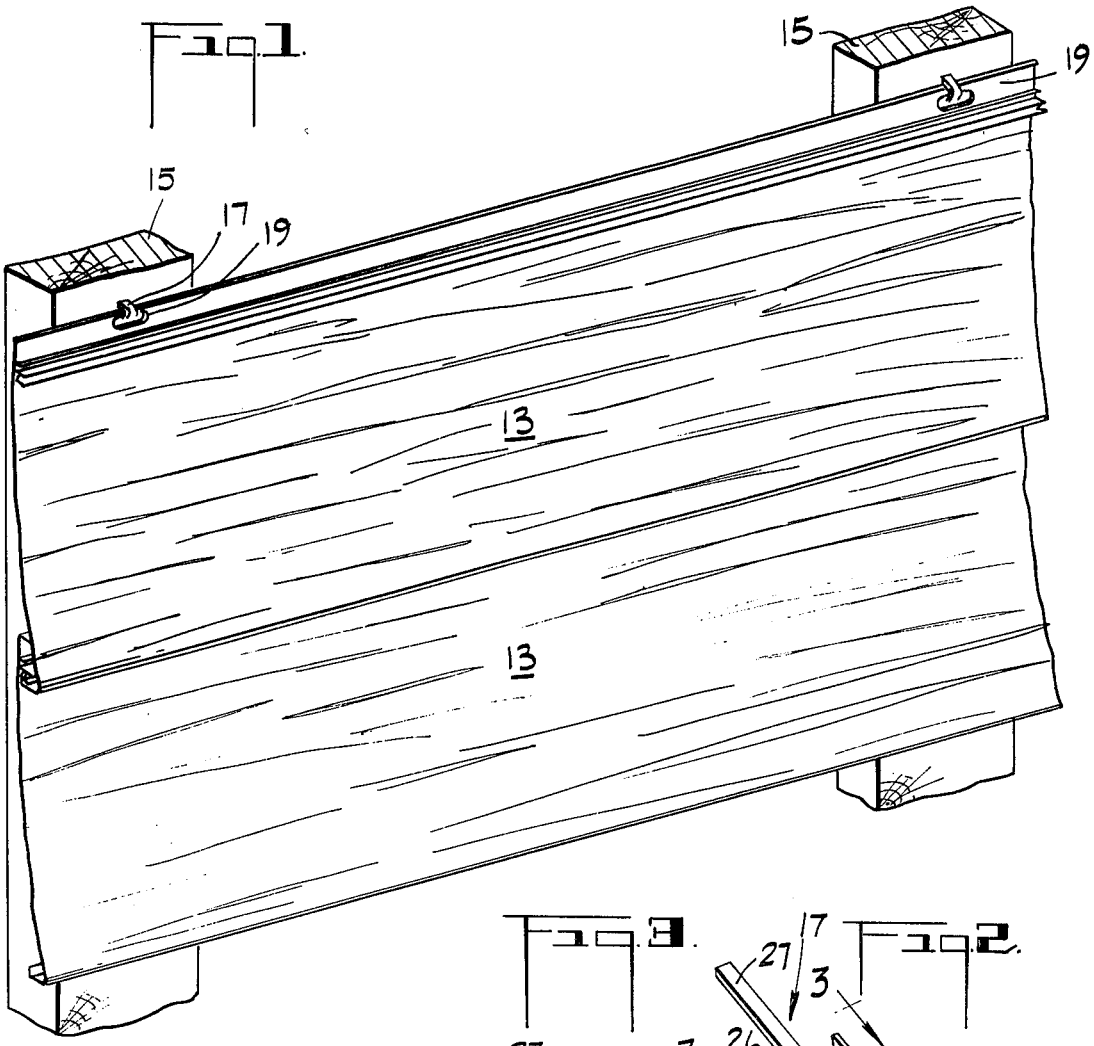
FIG. 1 is a fragmented view in perspective of sections of vinyl siding fastened to supports by the fastening apparatus of the invention according to the method of the invention.

Referring to the drawings, FIG. 1 illustrates segments of horizontally extending vinyl siding panels 13 which have been secured to supports which commonly are wooden studs 15 according to the method of the invention and with the fastener and the fastening apparatus of the invention. The panels 13 typically are about 12½ feet long and extend horizontally across the front surfaces of the spaced-apart and parallel studs 15, which form the outer wall of a building structure. In some instances an air barrier will be secured to the studs prior to the application of the shingles. Along a longitudinally extending upper portion of panel 13, at locations adjacent the substrate studs 15, are longitudinally extending slots 19 through which extends, as shown in FIG. 1, a looping portion of a metallic fastener 17. The slots 19 are formed at the time of application of the fasteners 17.

Figure 3:
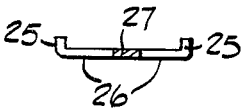
FIG. 3 is a cross-sectional view taken along lines 3—3 of FIG. 2.
Figure 2:
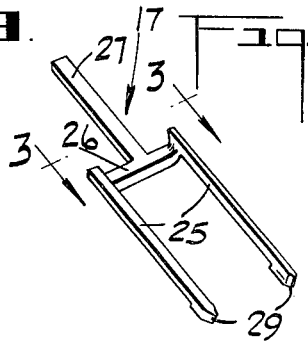
FIG. 2 is a view in perspective of a preferred embodiment of the fastener of the invention.

The preferred fastening means of the invention, shown in FIG. 2, is a metallic staple-like fastener 17 that has a first forward portion that comprises the two parallel spaced-apart legs 25 of a U-shaped structure and shoulder 26 comprising the connecting portion of the U-shaped structure. The leading ends 29 of legs 25 are preferably tapered to form piercing edges. The second and third portions of the fastener 17 comprises a shank 27 which extends from the middle of shoulder 26 in a direction generally parallel to the direction of legs 25, the third portion being the greater part of the extension of shank 27, including the end thereof. Staple 17 is stamped and formed from preferably 16 gauge CRS sheet steel, and in the preferred embodiment, the shank 27 is approximately ¾ inch long; legs 29, including the length of the shoulder 26 are approximately ¾ inch long, and the width of the staple or the distance between the outsides of legs 25 is approximately ½ inch. Fastener 17 is preferably stamped and formed to provide on each leg leading end 29 a slightly projecting portion 75. When a supply 61 of fasteners 17 is mounted on a guide rack 59 of fastening apparatus 31, which apparatus is hereinafter described in detail, the projecting portion 75 will help minimize fastener jamming by eliminating to-and-fro play (as viewed in FIG. 4) of fastener ends 29 of the fasteners in the supply 61. FIG. 3 illustrates that in a cross-sectional end view the legs 25 and shoulder 26 form three sides of a rectangle, thus when the legs 25 and shoulder 26 of staple 17 are driven entirely through a sheet of vinyl with the apparatus and by the method hereinafter described, a slot having the configuration of three sides of a rectangle will be cut.

Figure 5:
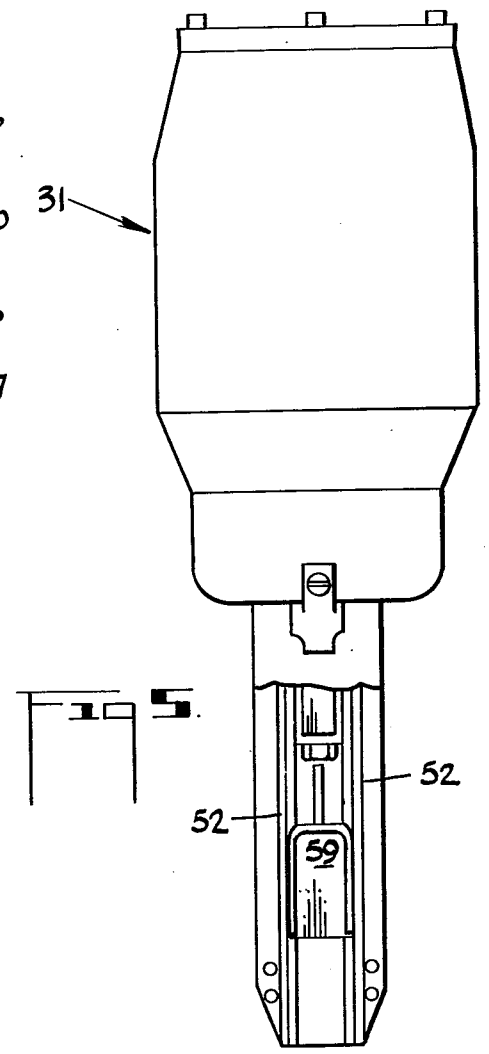
FIG. 5 is a front view of the apparatus of FIG. 4, with parts broken away.
Figure 4:
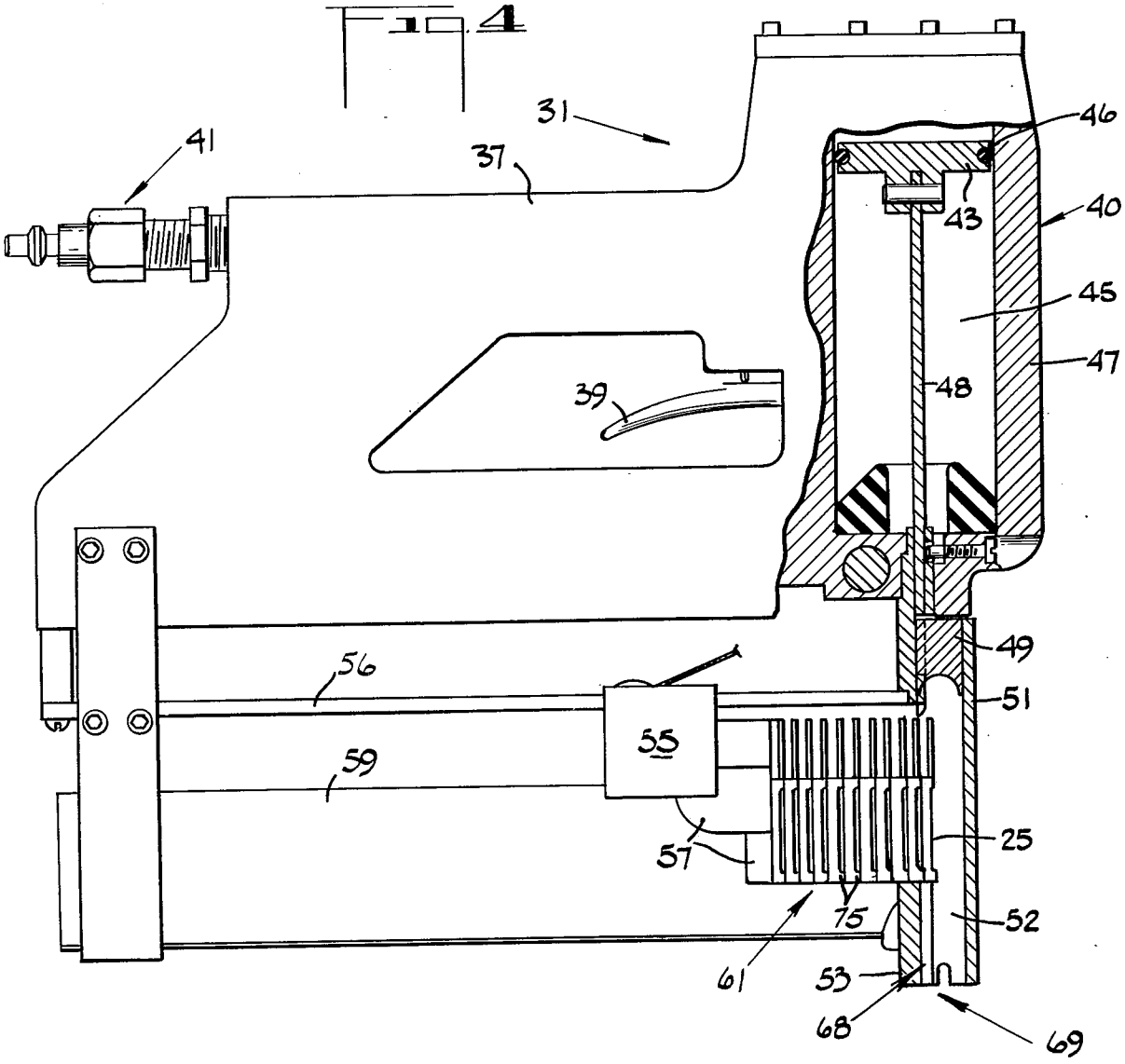
FIG. 4 is a side view of the fastening apparatus of the invention with parts broken away.

As shown in FIG. 4 and FIG. 5, the fastening apparatus 31 includes an air-power cylinder 40 of conventional construction that comprises a piston 43 mounted for movement in piston chamber 45 with elastomer piston ring 46 engaging the inner surface of the cylinder wall 47, and drive member 48 which is fixedly secured to the piston 43 and mounted for reciprocating movement therewith. A staple shaping head 49 is affixed to the lower end of driving member 48 and is mounted for vertical movement as viewed in FIG. 4, within a channel bounded by front and rear guide members 51 and 53, and side guide members 52.

Figure 6:
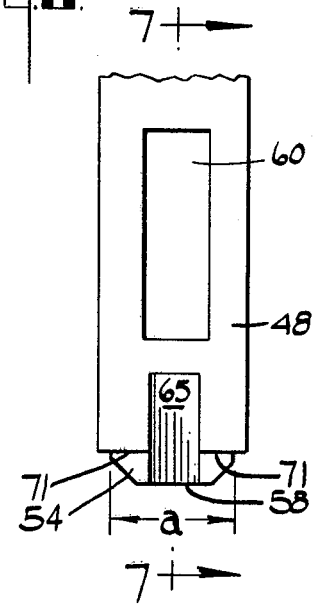
FIG. 6 is a frontal view of the lower portion of the fastener driving member of the fastening apparatus of the invention.
Figure 7:
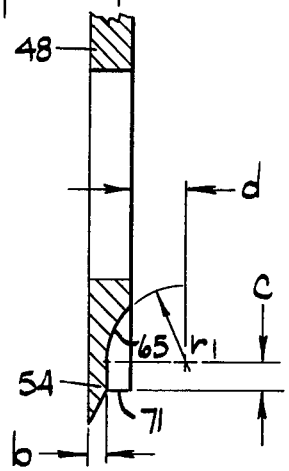
FIG. 7 is a cross-sectional view of the embodiment of FIG. 6, taken along lines 7—7.

In the preferred embodiment as in FIGS. 6 and 7 the extreme lower end of driving member 48 which is approximately ⅛" thick, has a tapered portion 54, about 3/32" long, which terminates in a cutting edge 58. The widest extent of tapered portion 54, represented by dimension a in FIG. 6, is slightly less than the spacing between insides of legs 25 of fastener 17, and the thickness of portion 54, represented by b in FIG. 7 is approximately 1/16". Driving faces 71 are flat downwardly facing surfaces for engaging upper surfaces of fastener shoulder 26 for exerting a downward, ejecting force on fastener 17. Above tapered portion 54 there is a concave surface 65 having a center of curvature located by reference to dimensions c and d which are approximately 3/32" and 3/16" respectively. The radius of curvature $r_1$ is approximately ¼".

Figure 8:
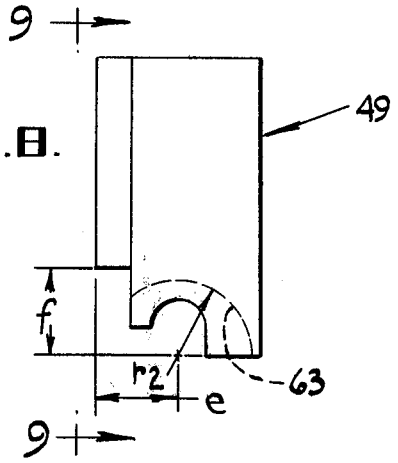
FIG. 8 is a side view of the fastener shaping head of the fastening apparatus of the invention.
Figure 9:
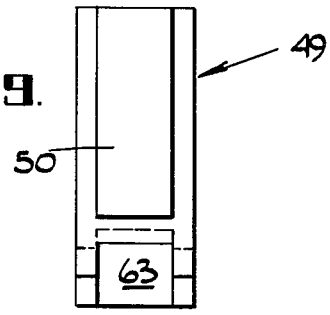
FIG. 9 is an end view of the shaping head of FIG. 8.
Figure 10:
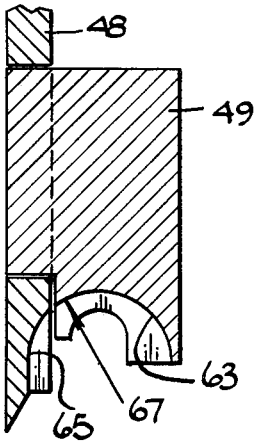
FIG. 10 is a longitudinal cross-sectional side view of the shaping head assembled into the lower portion of the fastener driving member.

The lower end of fastener shaping head 49, shown in FIG. 8, has a concave surface 63 having a center of curvature located by reference to dimension e which is approximately 9/32", and a radius $r_2$ of approximately ¼". A tongue 50, projecting from and integral with shaping head 49, is designed to fit into the slot 60 carried in driving member 48 such that shaping head 49 and driving member 48 will move vertically as a unit when assembled as shown in FIG. 10. FIG. 10 also illustrates that in this assembled configuration the centers of curved surfaces 63 and 65 coincide so that a combined concave shaping surface 67 is provided. It is preferred that parts 49 and 48 and associated structures be constructed of AISI A2 tool steel.

Apparatus 31, shown in FIG. 4, may be grasped by handle 37. Trigger 39 is engageable to direct air under pressure, which enters the apparatus at 41, into that portion of the air chamber 45 above piston 43, thus driving piston 43, driving member 48 and shaping head 49 rapidly in a downward direction as viewed in FIG. 4.

A supply 61 of fasteners 17, shown in FIG. 4, ride on a fastener guide rack 59 over which the U-shaped portions of fasteners 17 snuggly and slidably fit. A fastener feed block 55 mounted over guide track 56 and spring-biased (by means not shown) to move to the front, i.e. the right as viewed in FIG. 4, has fingers 57 which engage fastener legs 25 so as to feed the supply 61 to the right as viewed in FIG. 4 through an opening in the rear guide member 53. The forward and outer surfaces of legs 25 of the forward-most fastener in supply 61 fit into vertically extending guide tracks 68 in side members 52.

Figure 11:
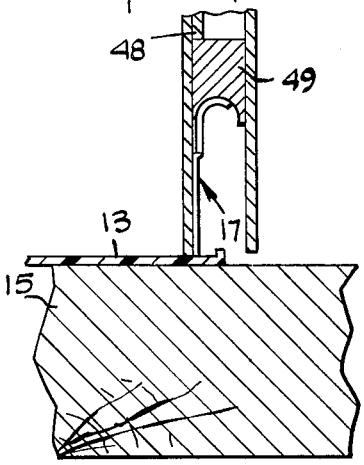
FIGS. 11 and 12 are partial cross-sections of the fastener ejecting end of the fastening apparatus, showing progressively the driving and shaping of the fastener of the invention.
Figure 12:
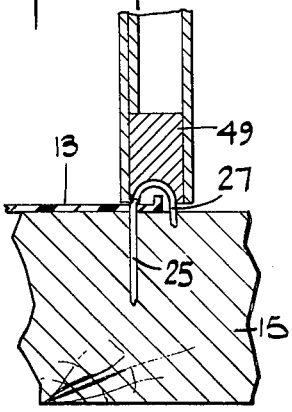

In the operation of apparatus 31 in the preferred method for fastening vinyl siding, a section of siding 13 is properly aligned with the upper portion 14 contacting the stud 15 as shown in FIG. 1. The fastener exit end 69 shown in FIG. 4, is then placed against the siding portion 14 in a position opposite a stud 15, as shown in FIG. 11. When trigger 39 is engaged, the driving member 48 and the shaping head 49 are driven rapidly downwardly, as viewed in FIG. 4. Tapered portion 54 engages the top end of shank 27 of the forwardmost fastener of supply 61, and directs it into sliding engagement with the turning surface 67. Fastener 17 will begin to be moved downwardly and inertial force will cause the shank 27 of the rapidly accelerating fastener to be bent by the surface 67 into a loop as shown in FIGS. 11 and 12. Fastener 17 will continue to be moved downwardly and the cutting edges 29 of legs 25 will pierce through the sheeting 13 as fastener 17 begins to exit apparatus 31. As shaping head 49 continues to move downwardly, shank 27 will be completely turned into a loop and the driving faces 71 of the lower portion of driving member 48, best shown in FIGS. 6 and 7, engage the upper surface of fastener shoulder 26 to exert downwardly driving force so as to move fastener legs 25 through the vinyl siding 13 and into stud 15. As FIG. 12 shows, as the driving head 49 nears the completion of its downward throw, a portion of the looped shank 27 is driven directly into the stud 15.

Figure 13:
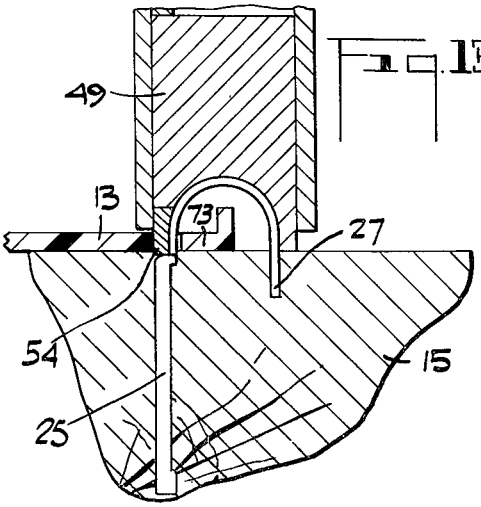
FIG. 13 is an enlarged partial cross-section illustrating the lowermost ejecting position of the driving member and shaping head, and the installed configuration of the fastener of the invention.

The application of fastener 17 is completed, as shown in FIG. 13, when legs 25 as well as the shoulder portion 26 have been completely driven through the siding 13 such that the top of shoulder 26 is at least flush with the top surface of stud 15. Because the fastener has the cross-sectional configuration as shown in FIG. 3, the driving of staple 17 through the body of the siding 13 will provide a corresponding cut having the configuration of three sides of a rectangle. It is the passage of the tapered portion 54 of driving member 48 through the siding 13 as shown in FIG. 13 that provides the cut that completes the formation of a rectangular slot in the siding 13. During this driving operation the rectangular piece of the siding material that is removed to form the slot is embedded into the body of stud 15. The shank 27 of a fastener thus installed loops upwardly through the middle of the elongated rectangular slot, straddles a siding edge portion 73 with some clearance and then curves back into engagement with stud 15 as shown in FIG. 13. While in the preferred embodiment the shank engages the stud 15, for functional purposes it is necessary only that it be contiguous thereto. This clearance between the looping shank 27 and the siding edge portion 73, the disparity between the size of slot 19, shown in FIG. 1, and the girth of staple shank 27, and the positioning of shank 27 at the middle of slot 19 provide for the desired relative longitudinal movement of siding panels 13 and limit movement of siding portion 14 away from stud 15.

Various modifications of the above-described embodiment of the invention will be apparent to those skilled in the art, and it is to be understood that such modifications can be made without departing from the scope of the invention if they are within the spirit and the tenor of the accompanying claims.

What is claimed is:

1. A method of fastening sheet material to a support comprising:

positioning a surface of a length of sheet material against a support;

cutting an elongated slot in said sheet material adjacent an edge of said length of sheet material while said surface of said length of sheet material is positioned against said support;

securing a fastener to said support by moving a first portion of said fastener into said support for frictional engagement with said support;

positioning a second portion of said fastener so that it extends through said slot;

controlling the dimensions of said slot so that said slot is larger than said second portion of said fastener that lies therein to permit movement of said length of sheet material relative to said fastener; and providing a fastening portion on said fastener by forming an initially straight third portion of said fastener into a loop that extends over said edge of said length of material, and moving an end of said third portion into contiguous relationship with said support so as to limit movement of said sheet material away from said support.

2. A method as defined in claim 1 wherein said cutting of said slot is at least partially rendered by moving said first portion of said fastener through said sheet material.

3. A method as defined in claim 1 and further comprising:

moving said end of said third portion into said support for frictional engagement with said support.

4. A method as defined in claim 1 and further comprising: cutting the remainder of said slot and substantially simultaneously embedding a portion of said sheet material in said support.

* * * * *